US005308149A

United States Patent [19]

Watson et al.

[11] Patent Number: 5,308,149

[45] Date of Patent: May 3, 1994

[54] NON-EXPLOSIVE DRILL HOLE PRESSURIZATION METHOD AND APPARATUS FOR CONTROLLED FRAGMENTATION OF HARD COMPACT ROCK AND CONCRETE

[75] Inventors: John D. Watson, Evergreen; Chapman Young, III, Steamboat Springs, both of Colo.

[73] Assignee: Sunburst Excavation, Inc., Denver, Colo.

[21] Appl. No.: 894,604

[22] Filed: Jun. 5, 1992

[51] Int. Cl.[5] ..... E21C 37/14; F42D 1/22; F42D 3/04

[52] U.S. Cl. ..... 299/13; 102/307; 102/313; 299/16

[58] Field of Search ..... 299/13, 14, 16; 102/307, 312, 313, 333

[56] References Cited

U.S. PATENT DOCUMENTS

| | | | |
|---|---|---|---|
| 1,189,011 | 6/1916 | Smith | 102/430 |
| 1,585,664 | 5/1926 | Gilman | 299/13 |
| 2,587,243 | 2/1952 | Sweetman | 102/307 |
| 2,799,488 | 1/1962 | Badali et al. | 89/33.1 |
| 3,055,648 | 9/1962 | Lawrence et al. | 299/13 |
| 3,307,445 | 3/1967 | Stadler et al. | 102/313 X |
| 3,421,408 | 7/1967 | Mandt | 89/33.1 |
| 3,623,771 | 11/1971 | Sosnowicz et al. | 299/12 |
| 3,721,471 | 3/1973 | Bergmann et al. | 299/55 |
| 3,735,704 | 5/1973 | Livingston | 102/332 |
| 3,848,927 | 11/1974 | Livingston | 299/13 |
| 3,975,056 | 8/1976 | Peterson | 299/42 |
| 3,988,037 | 10/1976 | Denisart et al. | 299/16 |
| 4,040,355 | 8/1977 | Hopler, Jr. | 102/313 |
| 4,099,784 | 7/1978 | Cooper | 299/10 |
| 4,123,108 | 10/1978 | Lavon | 299/16 |
| 4,141,592 | 2/1979 | Lavon | 299/16 |
| 4,149,604 | 4/1979 | Lockwood et al. | 175/77 |
| 4,165,690 | 8/1979 | Abrahams | 102/314 |
| 4,195,885 | 4/1980 | Lavon | 299/1.4 |
| 4,204,715 | 5/1980 | Lavon | 299/16 |
| 4,289,275 | 9/1981 | Lavon | 299/17 |
| 4,501,199 | 2/1985 | Mashimo et al. | 102/313 |
| 4,508,035 | 4/1985 | Mashimo et al. | 102/313 |
| 4,530,396 | 7/1985 | Mohaupt | 102/313 X |
| 4,582,147 | 4/1986 | Dardick | 175/1 |
| 4,655,082 | 4/1987 | Peterson | 299/1.2 X |
| 4,669,783 | 6/1987 | Kolle | 299/16 |
| 4,900,092 | 2/1990 | Van Der Westhuizen et al. | 299/13 |

FOREIGN PATENT DOCUMENTS

| | | | |
|---|---|---|---|
| 800833 | 9/1958 | United Kingdom | 299/16 |

OTHER PUBLICATIONS

"A Novel Concept for a Rock-Breaking Machine", Cooper et al, Institute CERAC SA, 1980.

*Primary Examiner*—David J. Bagnell
*Attorney, Agent, or Firm*—James Creighton Wray

[57] ABSTRACT

Rock and other hard materials, such as concrete, are broken by a controlled-fracturing process referred to as penetrating-cone fracture. The fracturing process is accomplished by pressurizing the bottom of a drill hole in such a way as to initiate and propagate a controlled fracture from the sharp hole-bottom corner while not crushing the surrounding rock. A cartridge containing a propellant charge is inserted at the bottom of a short hole drilled in the rock. The cartridge is stemmed by a massive bar. A firing pin in the stemming bar strikes a primer which then ignites the propellant in the cartridge. The cartridge incorporates a relief volume designed to control propellant burning rates and pressures and thus the pressure at the hole bottom. The cartridge is designed with a tapered wall, which is thicker nearer the stemming bar, and with a large radius of the inside surface of the cartridge base, which reduce the possibility for premature cartridge rupture and loss of propellant generated gases. A sealing mechanism on the stemming bar may also be used to form a seal near the hole bottom. The stemming bar is preferably connected to a boom mounted on a carrier. A preferred embodiment incorporates an indexing mechanism to allow both a drill and a stemming bar to be used on the same boom for drilling and subsequent charge insertion and firing operations. The major features of the method and apparatus are the relatively low energy of the flyrock and the relatively small amount of propellant required to break the rock.

29 Claims, 8 Drawing Sheets

PRIOR ART

NON-EXPLOSIVE DRILL HOLE PRESSURIZATION METHOD AND APPARATUS FOR CONTROLLED FRAGMENTATION OF HARD COMPACT ROCK AND CONCRETE

INTRODUCTION

The following describes a method and means to break rock efficiently and with low-velocity fly-rock such that drilling, mucking, haulage and ground support equipment can remain at the working face during rock breaking operations.

This is classed as a small-charge blasting method as opposed to a mechanical or conventional drill and blast type method for breaking rock. A small charge blasting method implies that the rock is broken out in small amounts as opposed to episodic conventional drill and blast operations which involve drilling, blasting, ventilating and mucking cycles.

The present invention involves breaking rock or other hard material, such as concrete, by drilling a short hole, placing a cartridge containing a propellant charge in the drill hole, positioning a massive stemming bar in the drill hole in contact with the cartridge, and igniting the propellant. Since the propellant charge is placed in the drill hole, this approach is referred to as the Hole Bottom Pressurization or HBP method. Ignition and burning of the propellant pressurizes the bottom of the drill hole and induces a controlled fracturing of the rock. If the rock is massive without extensive jointing, this controlled fracturing will be manifested by a type of fracture in the rock that is referred to as Penetrating Cone fracture (PCF).

The basic features of the PCF rock-breakage process are illustrated in FIG. 1. PCF breakage is based on the initiation and propagation of an axisymmetric fracture from the bottom corner of a short, rapidly pressurized borehole. Such a fracture initially propagates downward into the rock, and then turns towards the free surface as surface effects become important, resulting in the removal of a large volume of rock. The residual cone left on the rock face by the initial penetration of the fracture into the rock provides the basis for the name (Penetrating Cone Fracture, or PCF) given to this type of fracturing. A key feature of the hole-bottom controlled fracturing method is the benign nature of the flyrock which allows drilling, mucking, ground support and haulage equipment to remain at the working face during rock breaking operations.

RELATED PATENTS

"Controlled Fracture Method and Apparatus for Breaking Hard Compact Rock and Concrete Materials" U.S. Pat. No. 5,098,163, 24 Mar. 1992.

This patent relates to breaking rock by inducing a characteristic type of fracture called Penetrating Cone Fracture (PCF) by:

- drilling a short hole, with a length-to-diameter ratio in the range of 3 to 15, using a percussive drill. Practical hole diameters can range from 1 inch to 20 inches.
- using a gun-like device or gas-injector to burn propellant in a combustion chamber. The burning and burnt propellant then expands down a short barrel and into the bottom of the hole where it pressurizes the bottom of the hole to induce PCF. The barrel diameter of the gas-injector is smaller than the drill-hole diameter to provide adequate clearance.

One of the key features of this device is that the muzzle of the gas-injector forms a dynamic seal near the hole bottom so that only the hole bottom is pressurized. This allows the technique to operate effectively even in the presence of considerable natural fracturing in the rock mass. This method is referred to as the Gas Injector method or Injector method.

While the Injector method has proven practical and successful, it has the potential disadvantage of damaging the muzzle end of the gas-injector with repeated usage. The reason for this is that, under some operating conditions, the propellant load is never completely burned inside the gas-injector because it does not have the confinement of a projectile to allow the burning to go to completion. A significant fraction of the initial propellant load (15 to 30 percent) can be driven out of the gas-injector into the bottom of the hole in a partially burned condition, where it compacts and burns to completion extremely rapidly. If not controlled, this rapid burning can cause a very high-pressure pulse to develop which can damage the muzzle of the gas-injector.

The Injector method is illustrated schematically in FIG. 2. FIGS. 3 and 4 illustrate pressure histories in the gas-injector combustion chamber and in the hole bottom calculated with an explicit-finite difference technique. FIG. 3 illustrates a normal operation case where the majority of the propellant is burned in the chamber of the gas injector. In normal operation, pressures of 200 to 400 Mpa (29,000 to 58,000 psi) are achieved. Such pressures are necessary and sufficient to initiate and drive the desired penetrating-cone fracture. FIG. 4 illustrates an abnormal case where the gas-injector hardware could be damaged. In the abnormal case, a significant mass of incompletely burned propellant is blown down the injector barrel to the bottom of the drill hole. When the incompletely burned propellant and burnt propellant gases impact the hole bottom, the pressure rises abruptly, causing the propellant burning rate to also rise abruptly. The incompletely burned propellant then burns extremely rapidly, driving up the pressure in the bottom of the hole. This causes a large pressure wave to be reflected back up the injector barrel. As illustrated in FIG. 4, the pressure in this reflected wave equals 1,100 MPa (or 159,500 psi) and could substantially exceed the strength capacity of the injector barrel causing severe deformation or rupture of the muzzle end of the barrel.

Another advantage of the HBP method relative to the Injector method is the requirement to burn additional propellant in the injector to pressurize the internal volume of the injector. The internal volume of the gas-injector barrel and combustion chamber are comparable to the volume of the hole bottom that is desired to be pressurized. This additional propellant, when burned, ultimately contributes to the air-blast, ground vibration and flyrock energies, all of which are unwanted by-products of the rock-breaking process. The HBP approach eliminates the additional gas-injector internal volume since the hole bottom is acting as the combustion chamber.

PRESENT INVENTION

The present invention represents a significantly different means to induce hole-bottom controlled fracturing, such as the Penetrating Cone Fracture (PCF) type of rock fracture. However, it retains the major advantages of the Injector method in that rock is broken efficiently and the resulting flyrock is so benign that equipment can remain at the working face while the rock is being broken. It differs from the Injector method in that the propellant cartridge, containing a solid or liquid propellant, is placed directly into the bottom of a percussively drilled hole, as illustrated in FIG. 1. The Hole Bottom Pressurization (HBP) cartridge is stemmed by a massive bar which contains a device for igniting the propellant charge. The stemming bar provides inertial confinement for the high-pressure gases developed when the propellant is burned.

The cartridge may be destroyed in one shot, but the end of the stemming bar is exposed to a controlled pressure pulse similar to that generated inside a propellant-driven gun and is unlikely to sustain damage over a large number of firings. Even if the end of the stemming bar adjacent to the cartridge is damaged from time to time, it is a relatively simple, low-cost operation to replace or repair the damaged end.

The wall of the cartridge is designed to expand to the drill hole wall without rupturing, thus preventing the high-pressure propellant gases from acting directly on the hole wall or in any fractures (natural or induced) along the hole wall. This containment of propellant gases maintains the gas pressure so that the propellant gases act predominantly to form and pressurize the desired penetrating-cone-fracture originating at the stress concentration developed at the bottom of the hole. It is important to prevent hot gases from escaping up the hole around the steel bar. Such gas escape would reduce both the pressure and volume of gas available for the desired PCF fracturing. Also the escaping gases could damage the stemming bar by convective heat transfer erosion processes.

In addition to or as an alternative to the sealing and gas containment provided by the charge cartridge as described above, sealing may be provided at the cartridge end of the stemming bar. Any of several sealing techniques, such as V-seals, O-rings, unsupported area seals, wedge seals, et cetera may be employed. The seals may be replaced each time a cartridge is fired or, preferably, the seals may be reusable. When the primary sealing function is provided only by the stemming bar, the design of the cartridge may be simplified considerably.

Hole sealing can be assisted and apparatus weight can be reduced by accelerating the stemming bar toward the hole bottom just prior to igniting the propellant in the cartridge. The stemming bar can be accelerated by the hydraulic or pneumatic power source that is used to move the boom or carrier for the HBP apparatus, or by any other means that are available. The stemming bar is accelerated to a velocity directed towards the hole bottom, which is comparable to the oppositely directed recoil velocity induced by burning the propellant. These velocities are on the order of 5 to 50 feet per second. The prefiring acceleration must be sufficient to achieve the desired velocity in a short distance, on the order of a third of a hole diameter (an inch or less in a 3-inch diameter hole) . This technique is referred to as "firing out-of-battery" and is sometimes employed in the operation of large guns to reduce recoil forces.

Since the recoil velocity of the HBP apparatus plays a major role in the hole sealing process, it is important to minimize recoil velocity. The firing out-of-battery technique can accomplish this. Alternatively, if recoil velocity is acceptable, this technique can be employed to reduce the recoil mass. In the CIH method, the HBP apparatus serves as a large part of the recoil mass and thus the weight of the apparatus may be reduced. Weight reduction is an important goal since the carrier and boom can operate more efficiently with less weight associated with the drill and HBP apparatus.

The firing out-of-battery technique can also be used to assist the sealing operation when sealing is provided by the propellant cartridge. The seal provided by the cartridge is usually broken when the base of the cartridge ruptures and separates from the body of the cartridge as the stemming bar recoils out of the hole (the body of the cartridge is held against the drill hole walls by the high-pressure propellant gases and cannot move relative to the hole). By firing out-of-battery, the recoil velocity of the stemming bar can be reduced and the out-of-hole displacement of the stemming bar can be delayed, giving the high-pressure propellant gases significantly more time to act on the hole bottom and drive the penetrating cone fracture to completion.

The closure disc of the cartridge adjacent to the bottom of the drill hole is designed to rupture or disintegrate when the propellant is burned so that the hole bottom is exposed to the high-pressure gases. These gases can then cause a PCF type fracture to develop and the gases can then drive this fracture deep into the rock. A space between the closure disk and the hole bottom provides a volume into which the burning propellant can expand. This volume is important to the control of the peak propellant burn pressures and provides, through control of the volume, the means to control the gas pressures applied to the material to be fractured and the cartridge. Gas pressures sufficient for PCF fracture development but below those which would rupture the cartridge may thus be attained in a controlled manner. The pressures thus developed are maintained below those which would deform or damage the end of the stemming bar and below those which would crush the rock around the hole. An important feature of the HBP process is the elimination of crushed rock which is a primary source of dust. Excess dust requires additional equipment and time to control and can, in some types of excavation operations, lead to secondary explosions which are a safety hazard.

FIG. 5 illustrates a typical pressure history calculated for a HBP cartridge. This pressure history can be compared to the pressure history of FIG. 3 for the injector method of inducing PCF type fractures. The pressure history in the HBP cartridge is much less dynamic than that in the Injector system. This is because the propellant gases in the HBP cartridge need only expand into the small relief volume at the bottom of the HBP cartridge and the pressure increases by small reflection pulses to a maximum of 400 MPa (or 58,000 psi). In the Injector method, the propellant gases developed in the combustion chamber must expand down the injector barrel to reach the bottom of the drill hole. Through this expansion, internal energy is converted to kinetic energy over the length of the barrel. As a result, the gas pressure decreases and the gas velocity increases. When the high-velocity, low-pressure gases encounter the bottom of the hole, kinetic energy is abruptly converted back to internal energy and the gas pressure rises abruptly. In the Injector method, pressure waves reflect back and forth in the injector and hole bottom in a much more dynamic fashion than in the HBP method, causing much higher pressure transients.

The basic components of the HBP system are:

boom assembly and carrier drill mounted on the boom assembly
the cartridge magazine and loading mechanism
the stemming bar and propellant ignition mechanism
the cartridge and primer
the propellant The basic components of the system are shown schematically in FIG. 6. The following paragraphs describe the envisioned characteristics of the various components.

The Boom Assembly and Carrier

The carrier may be any standard mining or construction carrier or any specially designed carrier for mounting the boom assembly or boom assemblies. Special carriers for shaft sinking, stope mining, narrow vein mining and military operations, such as trenching, fighting position construction and demolition charge placement, may be built.

The boom assembly may be comprised of any standard mining or construction articulated boom or any modified or customized boom. The function of the boom assembly is to orient and locate the drill and HBP device to the desired location. The mass of the boom assembly also serves to provide recoil mass and stability for the drills and HBP device.

Drill

The drill consists of the drill motor, drill steel and drill bit, and the drill motor may be pneumatically or hydraulically powered.

The preferred drill type is a percussive drill because a percussive drill creates micro-fractures at the bottom of the drill hole which act as initiation points for penetrating-cone fracture. Rotary, diamond or other mechanical drills may be used also. In these cases the bottom of the hole may have to be specially conditioned to promote the PCF type of fracture.

Standard drill steels can be used and these can be shortened to meet the short hole requirements of the HBP method.

Standard mining or construction drill bits can be used to drill the holes. Percussive drill bits that enhance micro-fracturing may be developed. Drill hole sizes may range from 1-inch to 20-inches in diameter and depths are typically 3 to 15 hole diameters deep.

CIH Cartridge Magazine and Loading Mechanism

The HBP cartridges are stored in a magazine in the manner of an ammunition magazine for an autoloaded gun. The loading mechanism is a standard mechanical device that retrieves a cartridge from the magazine and inserts it into the drill hole. The stemming bar described below may be used to provide some or all of this function.

The loading mechanism will have to cycle a cartridge from the magazine to the drill hole in no less than 10 seconds and more typically in 30 seconds or more. This is slow compared to modern high firing-rate gun autoloaders and therefore does not involve high-acceleration loads on the HBP propellant cartridge. Variants of military autoloading techniques or of industrial bottle and container handling systems may be used.

The Stemming Bar and Firing Mechanism

This is a major component of the present invention. The stemming bar will be made from a high-strength steel with good fracture toughness characteristics. It can also be made from other materials that combine high density/mass for inertia, strength to withstand the pressure loads without deformation and toughness for durability. Alternately, a high-strength steel stemming bar with a non-metallic end section can be employed. This end section can be made from a high-impact material such as urethane to help isolate the main stemming bar from occasional high-pressure overloads.

The stemming bar is attached to the main indexing boom mechanism as illustrated in FIG. 6. The stemming bar typically extends well into the drill hole. The stemming bar makes firm contact with the propellant cartridge to provide good contact for initiating the primer and to confine the cartridge at the bottom of the drill hole as the propellant is burned. The diameter of the stemming bar is just less than the drill hole diameter, enough to provide clearance for the bar in the hole. The stemming bar contains the firing mechanism for the propellant cartridge. This firing mechanism may be mechanical (percussive), electrical or optical in function.

Additional sealing against the escape of the propellant generated gases may be provided at the cartridge end of the stemming bar. Any of several conventional sealing techniques, such as V-seals, O-rings, unsupported area seals et cetera, may be employed. The additional sealing would serve to further limit the undesirable escape of propellant generated gases from the cartridge and the bottom of the hole. Additional sealing of the propellant generated gases may be achieved also by accelerating the stemming bar into the hole just prior to ignition of the propellant charge such that the inertia of the stemming bar into the hole provides additional forces against the displacement of the cartridge out of the hole and the consequent cartridge rupture and loss of high-pressure propellant gases.

The HBP Cartridge and Primer

The HBP cartridge is a major component of the present invention. Its function is to act as a storage container for the solid or liquid propellant, to serve as a means of transporting the propellant from the storage magazine to the bottom of the drill hole, to serve as a combustion chamber for the propellant and to provide a sealing mechanism for the propellant gases as the propellant is burned in the drill hole.

In addition to containing the propellant charge, the HBP cartridge contains a relief volume as illustrated in FIG. 1. This relief volume is necessary to control the peak propellant pressures developed as the propellant is burned. Without this relief volume, the propellant burning could accelerate uncontrollably and the propellant could even detonate in the confined space. Such detonation could cause high-pressure shock waves that might damage the end of the inertial confinement bar. Such rapid burning or detonation of the propellant is also not suitable for inducing PCF type fracturing, as the process is too abrupt to properly pressurize the desired fractures without creating undesirable fractures and/or crushing the material. The fines generated by such crushing could plug the fractures, thus preventing their proper pressurization by the propellant gases. Also the generation of fines represents an undesirable energy loss. This rapid burning is also likely to rupture the HBP cartridge sealing action along the cartridge wall or at the end of the cartridge adjacent to the stemming bar, causing gas pressure to drop prematurely and or thermal ablation damage to the bar.

One of the main design criteria for the cartridge is to provide proper sealing in the drill hole for the burning or burnt propellant gases under controlled burning conditions. The cartridge must be designed to seal adjacent to the stemming bar, around the drill hole walls and to only allow the high-pressure propellant gases to flow out of the cartridge at the end towards the bottom of the drill hole. The cartridge must also be designed to seal around the primer hole. A simple cartridge design with features to ensure proper drill hole sealing and containment of the propellant gases is shown in FIG. 7. Through several field tests, it has been established that HBP cartridge must have a combination of the proper geometry and the proper material properties to prevent premature cartridge rupture, which results in the premature loss of propellant gas pressure, which, in turn, aborts the desired PCF process. The cartridge design illustrated in FIG. 7 satisfies the general requirements by combining a tapered wall and large internal radius at the base, both of which tend to prevent the premature failure of the cartridge near the cartridge base. Wall tapers in the range of 3 to 30 degrees are satisfactory, with tapers between 5 and 15 degrees being preferred.

The cartridge may be made from any tough and pliable material, including most plastics, ductile metals, and properly constructed composites. The cartridge must be made of a material which can deform either elastically and/or plastically, with sufficient deformation prior to rupture to allow the cartridge containment to follow both the expansion of the drill hole walls and the recoil of the stemming bar during the rapid borehole pressurization and PCF process. The cartridge may also be made from a combustible or consumable material such as used in combustible cartridges occasionally used in gun ammunition. The preferred materials are those that will provide the required sealing and that can be made for the lowest cost per part.

Reusable cartridges can also be employed. In these, the end adjacent to the bottom of the drill hole would be consumed with each shot. The remainder of the cartridge must be recovered, reprimed, refilled with propellant and refitted with a new bottom disk to hold the propellant in the cartridge.

A second cartridge design is illustrated in FIG. 8. In this design, a mechanical action is used to reduce some of the geometry and material property requirements of the first cartridge design. This HBP cartridge is constructed of a pliable sleeve and basal sealing plug. The pliable sleeve is tapered to provide a greater resistance to premature rupturing of the cartridge near its base and to provide an interference seal with the basal sealing plug, which is also tapered. The basal sealing plug can be constructed from any solid material, such as a plastic, a metal or a composite. The preferred materials are those that can be made for the lowest cost per part. The basal sealing plug contains the primer required to ignite the propellant charge.

The primer fits into the cartridge at the end adjacent to the stemming bar. Its function is to initiate propellant burning when actuated by a command from the operator. Standard or novel propellant initiation techniques may be employed. These include percussive primers, where a mechanical hammer or firing pin detonates the primer charge; electrical primers, where a capacitor discharge circuit provides a spark to detonate the primer charge; thermal primers, where a battery or capacitor discharge heats a glow wire; or an optical primer, where a laser pulse initiates a light sensitive primer charge.

The Propellant

Propellants rather than explosives are employed in the present invention. Propellants burn sub-sonically and pressure build-up is controlled by the propellant geometry; propellant chemistry; propellant loading density; ullage or empty space in the cartridge; and confinement of the cartridge/propellant system between the walls of the drill hole and the stemming bar. With this control, the bottom of the drill hole can be pressurized until a penetrating cone fracture is initiated along the line of maximum stress concentration on the perimeter of the hole bottom. The propellant gases then expand into the PCF and drive the fracture deep into the rock and/or to nearby free surfaces.

An explosive charge, on the other hand, would detonate which is a supersonic type of burning that generates strong shock waves. This would also pressurize the bottom of the drill hole but pressure build-up would be so abrupt that the rock around the borehole would excessively fractured and crushed. As a result, the fractured and crushed rock around the drill hole would allow the explosive product gases to escape prematurely and would consume energy in an undesirable mode. The amount of rock broken would be less than that from a PCF type of fracture pattern; there would be considerably more dust from the pulverized rock; and the broken rock flyrock, would be propelled away from the face at considerably higher throw velocities.

The propellants that would be used in the present invention may be in granular form or may be in single-grain solid form. These solid propellants may contain one or more of the following components:

- nitrocellulose
- nitroglycerine
- nitroguanadine
- black powder

Liquid propellants can also be employed. These include LGP 1984 and its derivatives, the JP4/nitric acid system and any other liquid propellant that can be controllably initiated and burned. One of the main requirements for the propellant is low cost and high-production capacity.

APPLICATIONS

This method of breaking soft, medium and hard rock as well as concrete has many applications in the mining, construction and rock quarrying industries and military operations. These include:

- tunneling
- cavern excavation
- shaft-sinking
- adit and drift development in mining
- long wall mining
- room and pillar mining
- stoping methods (shrinkage, cut & fill and narrow-vein)
- selective mining
- undercut development for vertical crater retreat (VCR) mining
- draw-point development for block caving and shrinkage stoping
- secondary breakage and reduction of oversize
- trenching
- raise-boring
- rock cuts precision blasting
demolition
open pit bench cleanup
open pit bench blasting
boulder breaking and benching in rock quarries
construction of fighting positions and personnel shelters in rock
development of large holes or chambers for placing demolition charges
reduction of natural and man-made obstacles to military movement

DETAILED DESCRIPTION OF THE DRAWINGS

Figure 1:
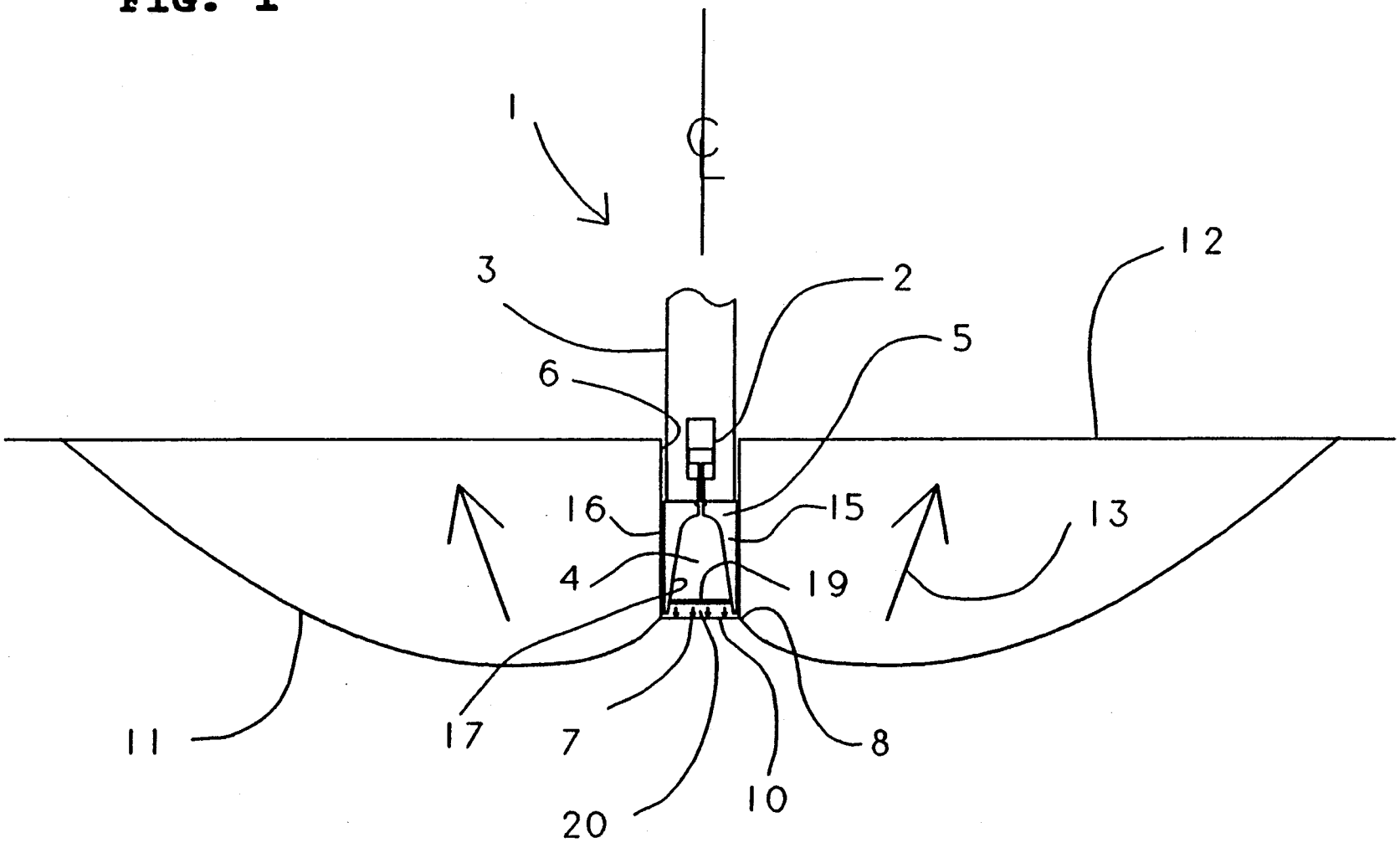
FIG. 1 is a cutaway side view of the present penetrating cone fracture process with a charge cartridge in the hole.

The penetrating cone fracture (PCF) system utilizing the Hole Bottom Pressurization (HBP) method and apparatus 1 of the present invention, as shown in FIG. 1, has a high-inertia stemming bar 3 with an igniter 2 for transporting, igniting and stemming a Propellant cartridge 5 with combustible propellant 4. Ignition of the propellant generates high-pressure gases which rapidly pressurize the borehole 6 as shown by arrows 7, causing PCF fracture 11 initiation at the corners 8 of the hole bottom 10, fracturing the rock along fracture line 11 and throwing the rock debris as shown by arrows 13. A borehole 6 is percussively drilled in the surface 12 of a rock or concrete material allowing placement of the cartridge 5 on the end of the stemming bar 3 in the hole. The cartridge 5 has a tapered body 15 with a generally cylindrical outer wall 16 and a sloping inner wall 17. A propellant charge 4 is held by a disk 19 at a space 20 above the bottom 10 of the hole 6.

Figure 2:
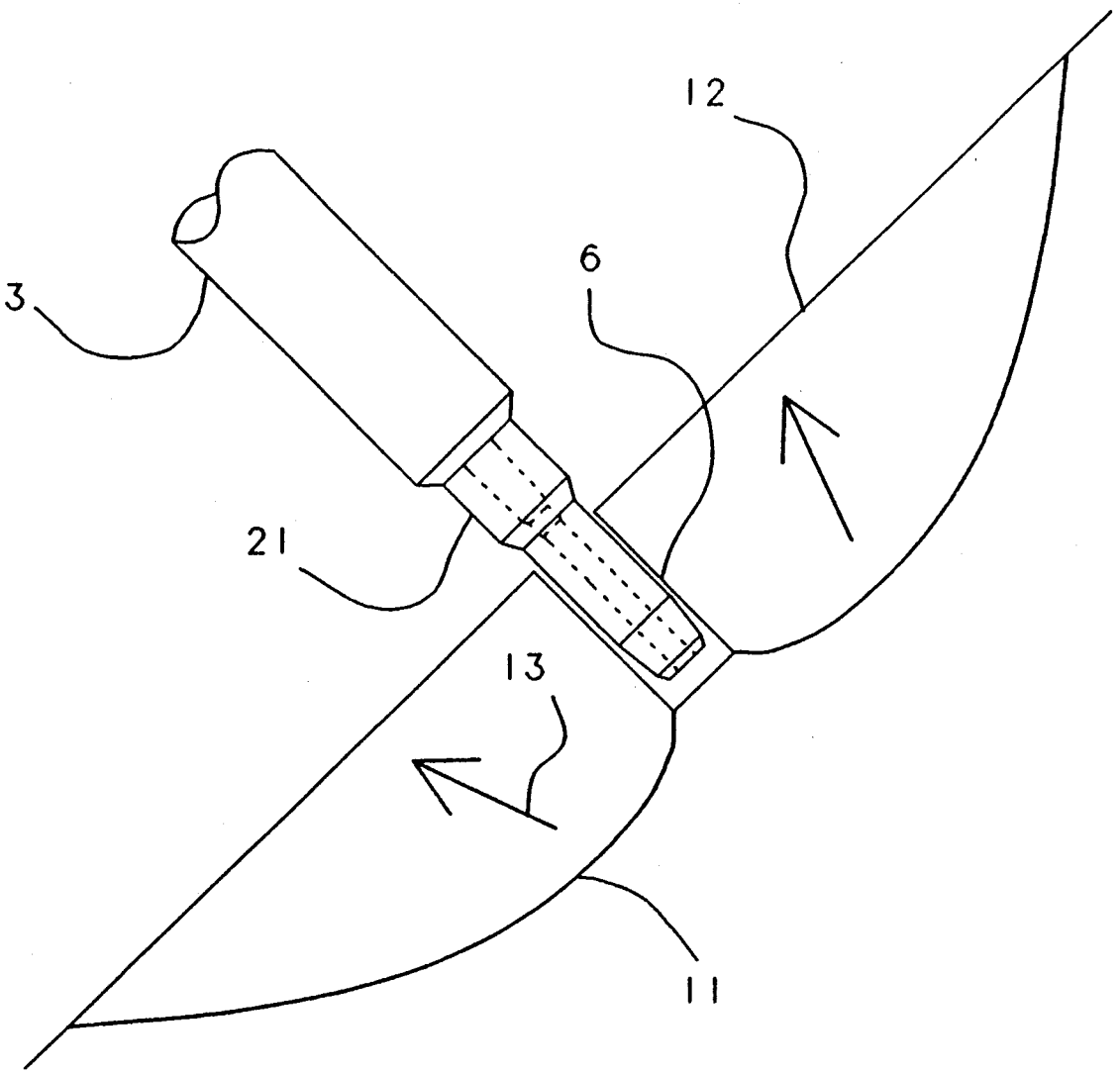
FIG. 2 is a cutaway showing the prior art gas injection method for penetrating cone fracture.
Figure 3:
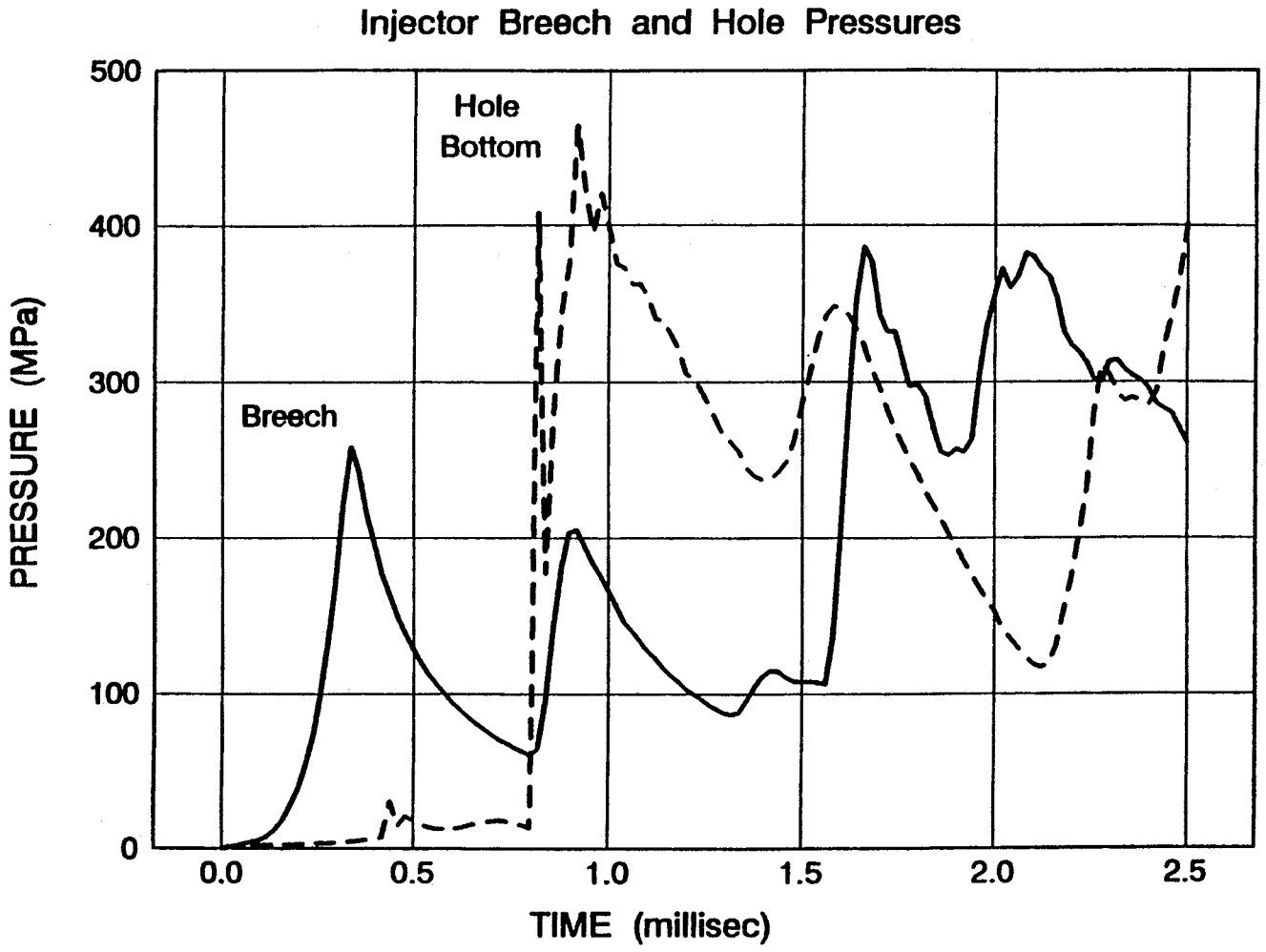
FIGS. 3 and 4 illustrate calculated pressure histories of the injector system.
Figure 4:
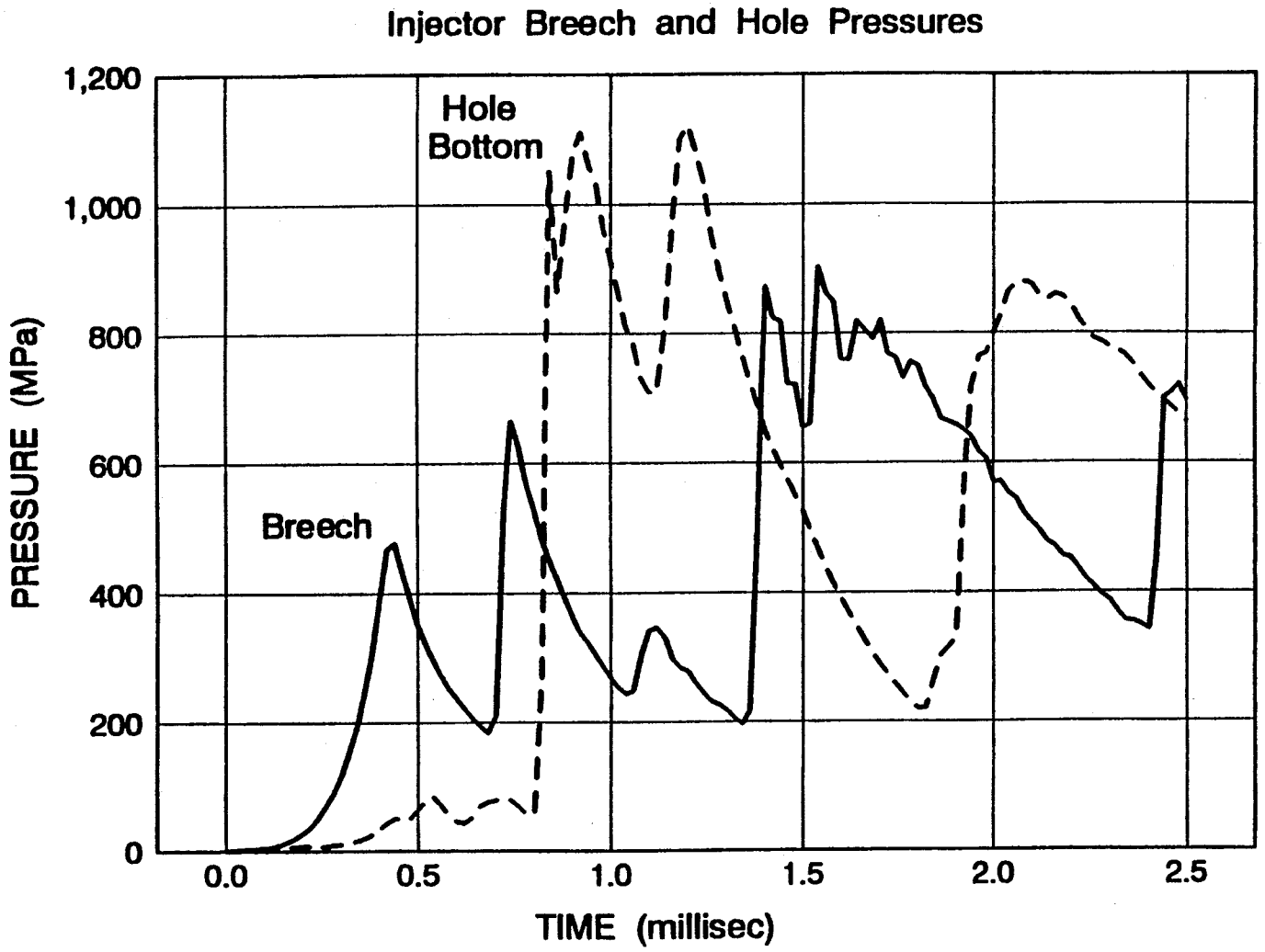

The prior patent, as shown in FIGS. 2, 3 and 4, provided a penetrating cone fracture 11 through expansion of a gas from an injector 21. The injector has an inertial stemming bar 3 backing a PCF propellant charge holder, causing a fracture 11 and a low energy rock throw 13, as previously described. The problems inherent with the prior method gas-injector hole pressures are illustrated by the calculated pressure histories shown in FIGS. 3 and 4, as previously discussed.

Figure 5:
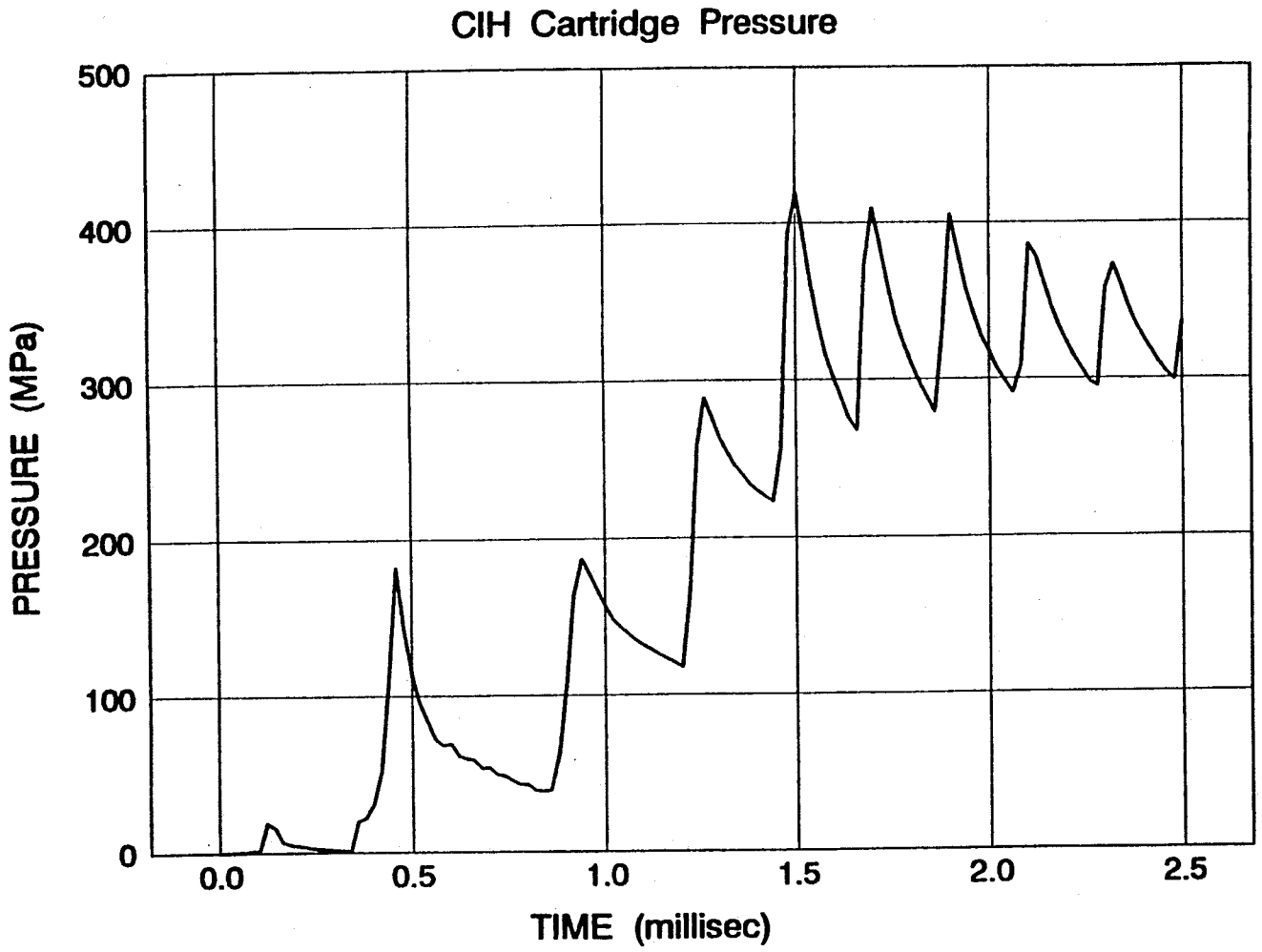
FIG. 5 illustrates a calculated pressure history for a Hole Bottom Pressurization cartridge.

On the other hand, as shown by the calculated pressure history illustrated in FIG. 5, the present HBP approach provides a more desirable hole and fracture pressurization.

Figure 6:
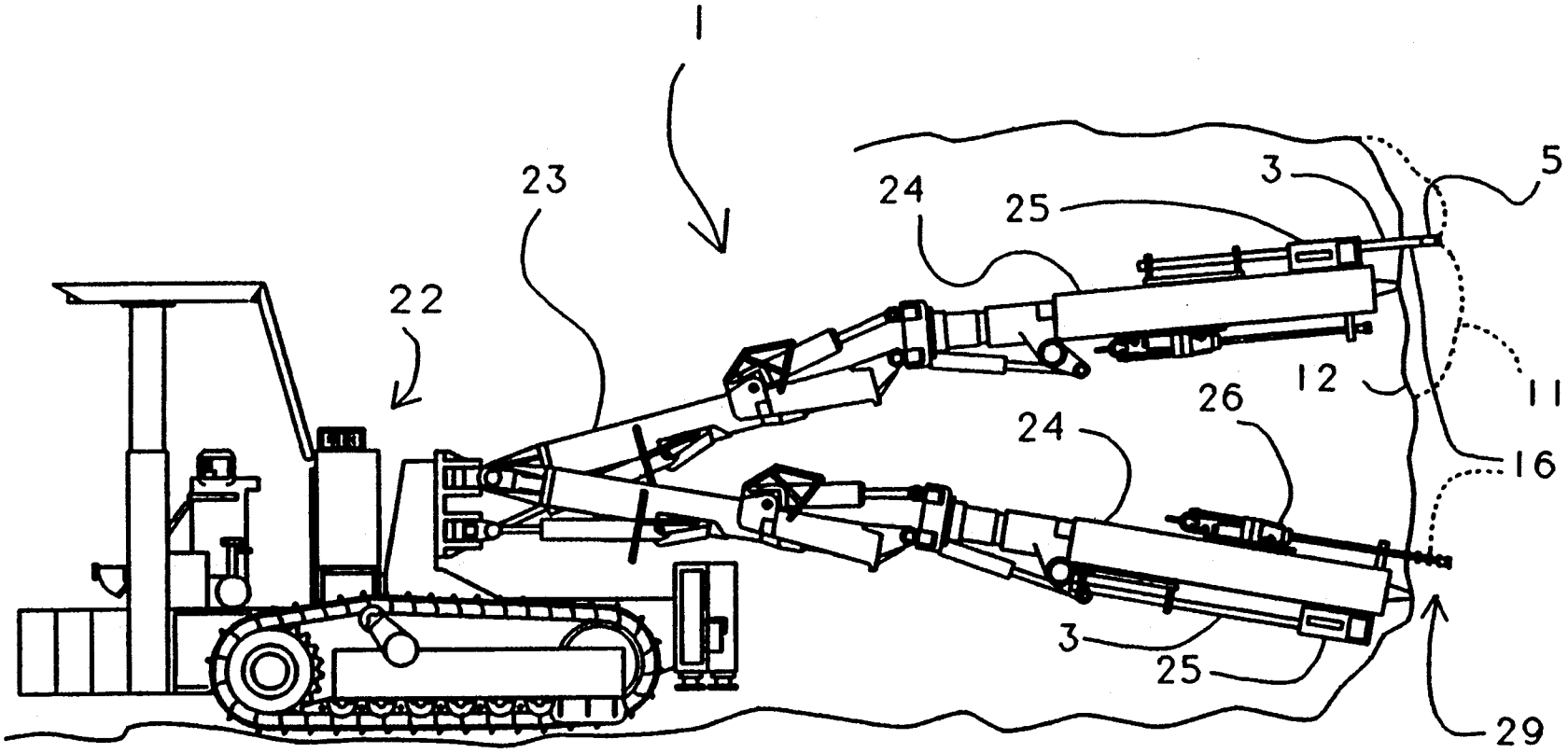
FIG. 6 shows the present invention in use with a typical carrier having plural booms, each boom comprising a means for drilling and then indexing the present Hole Bottom Pressurization cartridge into the hole.

The present penetrating cone fracture system, generally indicated by the numeral 1 in FIG. 6, has a conventional carrier 22 such as a tracked carrier, which has at least one boom. A preferred embodiment has two articulated booms 23, each with indexing extensions 24. Percussive drills 26 provide drilling 29 of boreholes 16. HBP autoloaders 25 are mounted on the indexing articulated booms 24. A high-inertia stemming bar 3 inserts, holds and stems a cartridge 5 to create PCF breakage 11 in the rock face 12. An autoloader 25 acts to place a propellant loaded cartridge 5 on the end of stemming bar 3 prior to insertion of the bar and cartridge into hole 16. To simultaneously drill and blast, both indexing booms 24 are provided with drills, stemming bars and loaders. Cartridge loading by the autoloader and insertion and igniting the cartridge with one boom may occur while the other boom is drilling a new hole. The operation may be automatic. Once the operator selects a drill spot, drilling, indexing, loading and inserting automatically occur.

Figure 7:
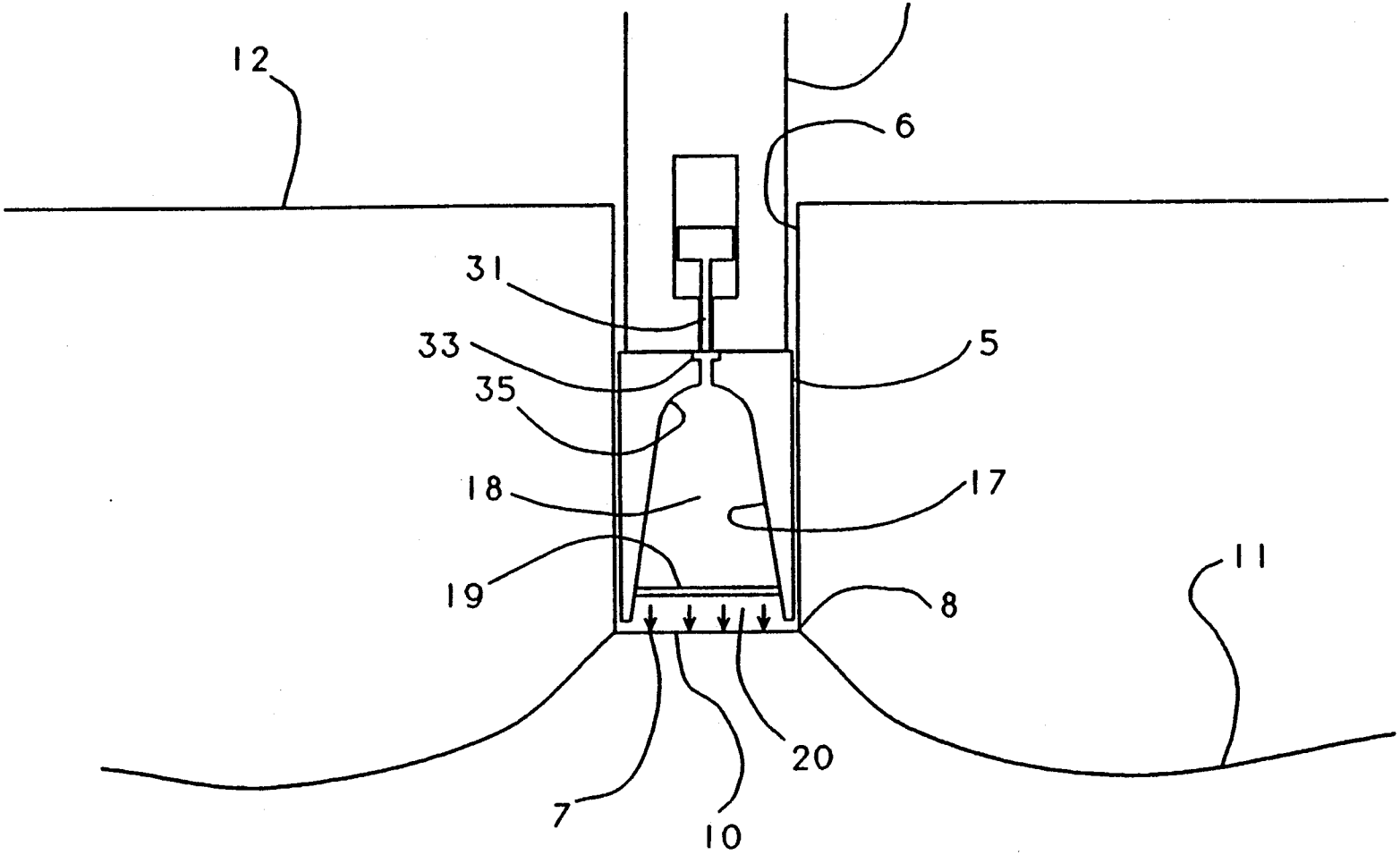
FIG. 7 is a cutaway close up side view of the present cartridge and stemming means showing the conical interior wall of the cartridge.

FIG. 7 shows the basic fracturing system of the present invention incorporating the stemming bar 3 abutting and backing the HBP cartridge 5 positioned in the borehole 6 drilled in the rock surface 12. The stemming bar 3 has a pneumatically, hydraulically or mechanically driven firing pin 31 for striking a percussive primer 33 in the base of cartridge 5 for igniting propellant charge 18. The propellant charge 18 is held within the cartridge by a sealing disk 19, providing a space 20. The resultant propellant burning rapidly pressurizes the space 20 and the borehole end 10 as shown by arrows 7. The cartridge 5 has a large radius base 35 which, in conjunction with the internal tapered wall 17, inhibits cartridge rupture and directs propellant generated high-pressure gases downward against the hole bottom.

Figure 8:
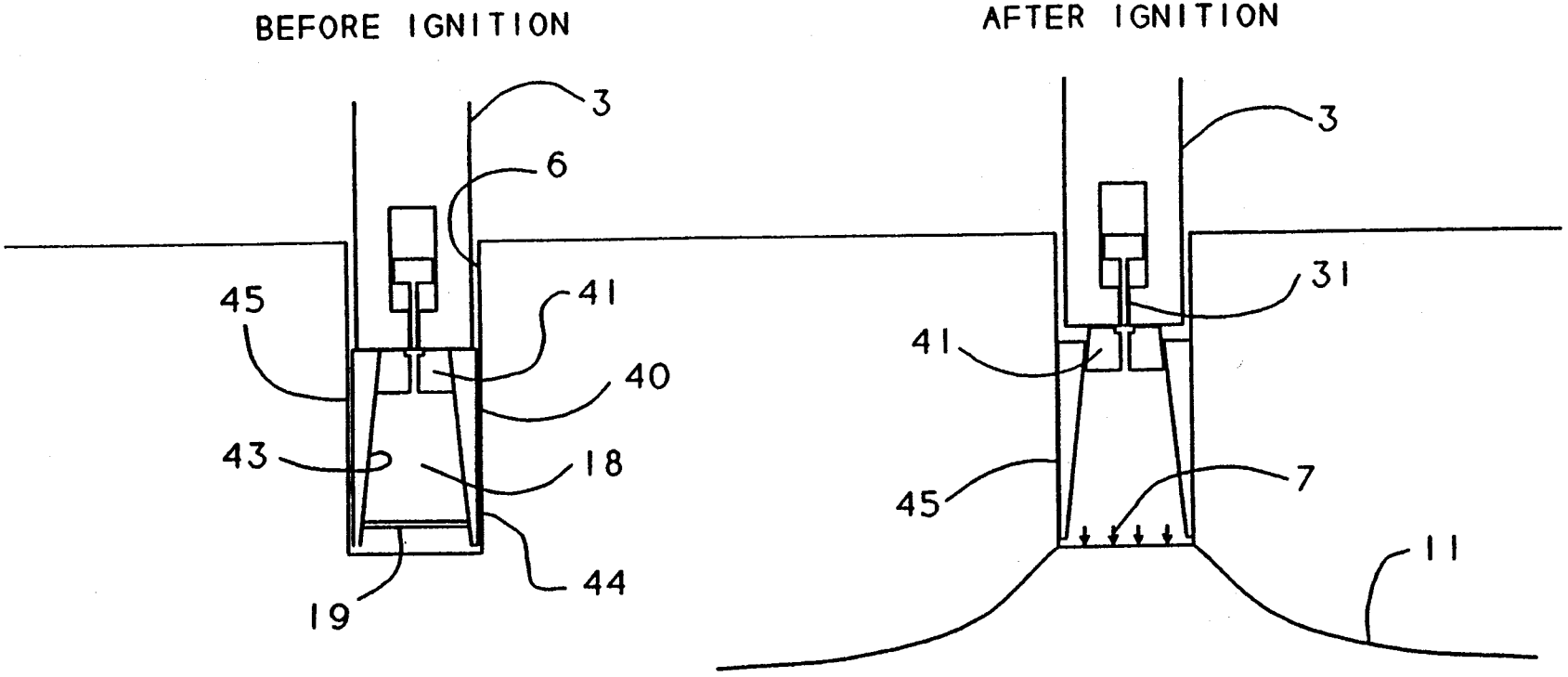
FIG. 8 shows pre- and post-ignition views of modified cartridges with inner plugs for forcing sealing of the cartridge post-ignition, and concentrating gas pressure on the hole bottom.

FIG. 8 shows an alternative cartridge 40, which incorporates a sliding plug 41 fitted within the conically tapered wall 43 of the cartridge. When the stemming bar 3 inserts the cartridge 40 and bar 3 into the drilled hole 6, a small space 44 typically surrounds the cartridge and could provide an avenue for fracture pressure reduction. However, as shown at the right, upon ignition of the propellant 18, the cartridge 40 expands to provide a tight fit between its outer wall 45 and the bore hole 6 and the sliding plug 41 is forced outward by the high gas pressure. Due to the tapered relation between the plug 41 and the inner wall 43, a seal is maintained at the base of the cartridge 40.

While the invention has been described with reference to specific embodiments, modifications and variations of the invention may be constructed without departing from the scope of the invention, which is defined in the following claims.

We claim:

1. An apparatus for breaking rock, concrete and other hard materials with penetrating cone fracture technique, comprising:

a carrier for underground or surface operation;

at least one articulated boom mounted on the carrier;

a drill mounted on the at least one boom for drilling a hole in the material to be broken;

a stemming bar carried on the at least one boom which carries at its end a propellant charge cartridge with a propellant;

an ignition system for igniting the propellant charge cartridge such that high pressure gases are generated and act to fracture the material through the initiation and propagation of controlled fractures from a a bottom of the hole thus effectively breaking and removing a volume of the material.

2. The apparatus of claim 1, wherein the end of the cartridge towards the bottom of the hole is sealed by a disk which is positioned within the cartridge and from the bottom of the hole so as to provide a controlled volume for the expansion of the burning propellant, thus controlling the propellant burning rats and peak pressures such that the pressure behavior for optimum rock fracture is achieved.

3. The apparatus of claim 2, wherein the sealing disk at the hole bottom end of the cartridge is made of a solid consumable material which could add to the total energy delivered by the propellant cartridge upon ignition.

4. The apparatus of claim 1, wherein the cartridge has a cylindrical external wall with a diameter slightly less than the hole drilled in the material and a conical interior wall such that the cartridge wall is thicker nearer the end towards the stemming bar.

5. The apparatus of claim 1, wherein the interior base of the cartridge has a large radius so as to reduce stress concentrations in the cartridge and thus minimize the consequent rupture of the cartridge due to the high pressures occurring with propellant ignition.

6. The apparatus of claim 1, wherein the cartridge comprises a tapered wall section with a cylindrical exterior and a conical interior and a basal sealing plug which can move inside the conical interior wall of the cartridge so as to maintain a seal against the propellant gases as the bar, which positions and stems the cartridge in the hole, is displaced out of the hole by the pressure of the gases.

7. The apparatus of claim 1, wherein the propellant is selected from a group consisting of a granular solid propellant, a single-grain solid propellant, a single-component liquid propellant, a two-component liquid propellant or any combination of the four propellant types.

8. The apparatus of claim 1, wherein the drill and the stemming bar are both carried on the same boom with an indexing mechanism allowing for the hole to be drilled, the drill retracted, the drill to be indexed out of alignment with the hole and the cartridge carrying stemming bar to be aligned with the hole and the cartridge inserted into the hole.

9. The apparatus of claim 1, wherein each cartridge is positioned on the end of the stemming bar by an automated cartridge handling autoloader.

10. The apparatus of claim 1, wherein the stemming bar has at its cartridge end, an additional or alternative sealing means to prevent the escape of high-pressure gases from the hole.

11. The apparatus of claim 1, wherein the stemming bar is accelerated into the hole just prior to ignition of the propellant charge such that a velocity of the stemming bar into the hole further prevents the displacement of the cartridge out of the hole and the consequent cartridge rupture and loss of high-pressure propellant gases, and reduces the recoil forces on the apparatus.

12. A method for breaking rock, concrete and other hard materials comprising the steps of:

drilling a hole in a material by a drilling means;

inserting into the hole a cartridge containing a propellant charge, the cartridge having an external diameter slightly less than a diameter of the hole;

stemming the hole with a relatively heavy bar having a diameter slightly less than the diameter of the hole and having a mass sufficient to limit the bar recoiling to less than one third the diameter of the hole;

igniting the propellant by any one of electrical, optical or percussive means;

fracturing the material by the initiation and propagation of controlled fractures from a bottom of the hole.

13. The method of claim 12, whereby the cartridge has a cylindrical external wall with a diameter slightly less than the drill hole and a conical interior wall such that the cartridge wall is thicker nearer the end towards the stemming bar.

14. The method of claim 12, wherein an interior base of the cartridge has a large radius so as to reduce stress concentrations in the cartridge and thus minimize the consequent rupture of the cartridge due to the high pressures occurring with propellant ignition.

15. The method of claim 12, whereby the cartridge has an internal relief volume to provide for the controlled pressurization of the hole bottom in such a way that initiates the controlled fracture process, eliminates damage to the end of the stemming bar, eliminates crushing of the rock around the drill hole, and minimizes the tendency of the cartridge to rupture during the fracture initiation and propagation process.

16. The method of claim 12, whereby the cartridge includes a basal sealing plug which can move inside the conical interior wall of the cartridge so as to maintain a seal against the propellant gases as the bar, which positions and stems the cartridge in the hole is displaced out of the hole by the pressure of the gases.

17. The method of claim 12, whereby the drilling is effected by percussive means thus increasing the number and size of microfractures at the hole bottom and thereby improving initiation of the penetrating cone fracture.

18. The method of claim 12, whereby the drilling means and the stemming bar are both carried on a boom with an indexing mechanism, allowing for the hole to be drilled, the drilling means retracted, the drilling means being indexed out of alignment with the hole and the stemming bar carrying a propellant cartridge on an end being aligned with the hole and inserted into the hole.

19. The method of claim 12, whereby an automated cartridge handling autoloader is used to position the cartridge on an end of the stemming bar prior to its insertion into the hole by the stemming bar.

20. The method of claim 12, whereby an end of the stemming bar proximal the cartridge provides the primary sealing of the hole bottom.

21. The method of claim 12, whereby the stemming bar provides a secondary seal for the hole bottom and the cartridge provides the primary seal.

22. The method of claim 12, whereby the stemming bar is accelerated towards the hole bottom just prior to firing the propellant charge to provide a reduction of recoil velocity of the stemming bar and an enhancement of sealing by the propellant cartridge as a result of reducing the displacement of a base of the cartridge relative to walls of the cartridge during the rock fracture process.

23. A cartridge apparatus for breaking rock, concrete and other hard materials by a hole-bottom pressurization process comprising:

a cartridge containing a propellant charge;

a primer at an up-hole end of the cartridge for igniting the propellant charge within the cartridge;

an internal relief column within the cartridge to control the rate of propellant burning, hole pressurization and maximum hole pressure;

the burning of the propellant such that high-pressure gases are generated and serve to fracture the material through the initiation and propagation of controlled fractures from a bottom of a drilled hole;

and thus effectively breaking and removing a volume of the material.

24. The apparatus of claim 23, wherein the cartridge has a cylindrical external wall with a diameter slightly less than the diameter of the drilled hole and a substantially tapered interior wall such that the cartridge body between the external and internal walls is thicker near the up-hole end, and the cartridge having a base with a large interior radius so as to reduce stress concentrations and thus rupture of the cartridge by the high-pressure gases occurring upon ignition of the propellant.

25. The apparatus of claim 23, wherein the cartridge interior wall comprises a conically tapered wall and the base comprises an equally tapered sealing plug which can move inside the conical interior wall of the cartridge for maintaining a seal against the high-pressure gases occurring upon ignition of the propellant.

26. A stemming bar apparatus for breaking rock, concrete and other hard materials by a controlled fracture process comprising:

a massive bar, made from steel or other high strength material, which is slightly less in diameter than a drilled hole;

a cartridge which contains a propellant charge and which is positioned at an end of the bar;

a firing mechanism to initiate an initiating device contained in the cartridge;

burning of the propellant charge to generate high-pressure gases a semicolon;

fracturing the material through the initiation and propagation of controlled fractures from a corner of a bottom of the drilled hole by the high-pressure gases;

and thus effectively breaking and removing a volume of the material.

27. The apparatus of claim 26, wherein a hole-sealing system is employed to seal the drilled hole near a bottom or in-hole end of the stemming bar to prevent high-pressure gases generated by the propellant from escaping from the bottom of the hole.

28. The apparatus of claim 26, wherein recoil forces on the stemming bar are reduced and bottom hole sealing is enhanced by accelerating the stemming bar towards the bottom of the hole, using any one of hydraulic, pneumatic or other power sources available, just prior to initiating the propellant charge.

29. The apparatus of claim 27, wherein the hole-sealing system is selected from a group consisting of V-seals, O-rings, unsupported area seals, or wedge seals.

* * * * *